US009918606B2

(12) United States Patent
Tran et al.

(10) Patent No.: US 9,918,606 B2
(45) Date of Patent: Mar. 20, 2018

(54) BARE FLOOR CLEANER

(71) Applicant: BISSELL Homecare, Inc., Grand Rapids, MI (US)

(72) Inventors: Phong H. Tran, Grand Rapids, MI (US); Gary A. Kasper, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 202 days.

(21) Appl. No.: 14/843,035

(22) Filed: Sep. 2, 2015

(65) Prior Publication Data

US 2015/0374195 A1 Dec. 31, 2015

Related U.S. Application Data

(62) Division of application No. 11/683,538, filed on Mar. 8, 2007, now Pat. No. 9,125,540.

(60) Provisional application No. 60/743,457, filed on Mar. 10, 2006.

(51) Int. Cl.

| | |
|---|---|
| ***A47L 13/22*** | (2006.01) |
| ***A47L 5/22*** | (2006.01) |
| ***A47L 5/28*** | (2006.01) |
| ***A47L 9/32*** | (2006.01) |
| ***A47L 7/00*** | (2006.01) |

(52) U.S. Cl.

CPC ..... *A47L 13/22* (2013.01); *A47L 5/225* (2013.01); *A47L 5/28* (2013.01); *A47L 7/0009* (2013.01); *A47L 9/325* (2013.01)

(58) Field of Classification Search

CPC ..... A47L 13/22; A47L 9/325; A47L 5/225; A47L 5/28; A47L 7/0009

See application file for complete search history.

(56) References Cited

U.S. PATENT DOCUMENTS

| | | | | |
|---|---|---|---|---|
| 2,138,279 | A | 11/1938 | Kneisley | |
| 2,622,254 | A | 12/1952 | Mendelson | |
| 2,986,764 | A | 6/1961 | Krammes | |
| 3,040,362 | A | 6/1962 | Krammes | |
| 3,079,626 | A | 3/1963 | Yonkers et al. | |
| 4,146,944 | A * | 4/1979 | Pinto | A47L 11/34 15/321 |
| 5,347,678 | A | 9/1994 | Williams et al. | |
| 5,392,491 | A | 2/1995 | Hwang et al. | |
| 5,924,167 | A | 7/1999 | Wright et al. | |
| 5,933,913 | A | 8/1999 | Wright et al. | |
| 5,968,281 | A | 10/1999 | Wright et al. | |
| 5,983,448 | A | 11/1999 | Wright et al. | |

(Continued)

FOREIGN PATENT DOCUMENTS

WO 2005018402 A2 3/2005

*Primary Examiner* — Robert Scruggs
(74) *Attorney, Agent, or Firm* — McGarry Bair PC

(57) ABSTRACT

A bare floor cleaner has a base and a handle pivotally connected to the base. The handle is movable between a dry mode position and a wet mode position. A fluid delivery system of the bare floor cleaner includes a source of cleaning fluid and a fluid distributor in fluid communication with the source of cleaning fluid for dispensing cleaning fluid onto a surface to be cleaned. A recovery system of the bare floor cleaner includes a disabling mechanism for disabling the recovery system when the fluid distributor is dispensing cleaning fluid onto the surface to be cleaned.

20 Claims, 12 Drawing Sheets

(56) References Cited

U.S. PATENT DOCUMENTS

| | | | |
|---|---|---|---|
| 6,000,088 | A | 12/1999 | Wright et al. |
| 6,065,182 | A | 5/2000 | Wright et al. |
| 6,101,668 | A | 8/2000 | Grey |
| 6,101,671 | A | 8/2000 | Wright et al. |
| 6,243,912 | B1 | 6/2001 | Grey |
| 6,243,921 | B1 | 6/2001 | Chang |
| 6,540,424 | B1 | 4/2003 | Hall et al. |
| 6,571,421 | B1 | 6/2003 | Sham et al. |
| 6,572,711 | B2 | 6/2003 | Sclafani et al. |
| 6,579,023 | B2 | 6/2003 | Kunkler et al. |
| 6,629,331 | B2 | 10/2003 | Panfili et al. |
| 6,629,332 | B2 | 10/2003 | Morgan et al. |
| 6,647,578 | B2 | 11/2003 | Morgan et al. |
| 6,663,306 | B2 | 12/2003 | Policicchio et al. |
| 6,669,391 | B2 | 12/2003 | Policicchio et al. |
| 6,814,519 | B2 | 11/2004 | Policicchio et al. |
| 6,842,936 | B2 | 1/2005 | Policicchio et al. |
| 6,851,158 | B2 | 2/2005 | Sclafani et al. |
| 6,854,911 | B2 | 2/2005 | Policicchio et al. |
| 6,893,180 | B2 | 5/2005 | Hall et al. |
| 6,899,485 | B2 | 5/2005 | Halle et al. |
| 6,910,823 | B2 | 6/2005 | Policicchio et al. |
| 6,948,873 | B2 | 9/2005 | Policicchio et al. |
| 6,953,299 | B2 | 10/2005 | Wang et al. |
| 6,964,535 | B2 | 11/2005 | Bell et al. |
| 6,976,802 | B2 | 12/2005 | Hall et al. |
| 6,986,619 | B2 | 1/2006 | Hall et al. |
| 7,823,250 | B2 | 11/2010 | Vander Baan |
| 9,125,540 | B2 * | 9/2015 | Tran ..... A47L 5/225 |
| 2002/0066153 | A1 | 6/2002 | Sclafani et al. |
| 2003/0009839 | A1 | 1/2003 | Streutker et al. |
| 2003/0028988 | A1 | 2/2003 | Streutker et al. |
| 2003/0051301 | A1 | 3/2003 | Morgan et al. |
| 2003/0051306 | A1 | 3/2003 | Morgan et al. |
| 2003/0051308 | A1 | 3/2003 | Morgan et al. |
| 2003/0051310 | A1 | 3/2003 | Morgan et al. |
| 2003/0077105 | A1 | 4/2003 | Hall et al. |
| 2004/0068817 | A1 | 4/2004 | Policicchio |
| 2004/0134016 | A1 * | 7/2004 | Kisela ..... A47L 5/24 15/320 |
| 2004/0134025 | A1 | 7/2004 | Murphy et al. |
| 2004/0139572 | A1 | 7/2004 | Kisela et al. |
| 2004/0226123 | A1 | 11/2004 | Policicchio et al. |
| 2004/0231700 | A1 | 11/2004 | Bell et al. |
| 2005/0034266 | A1 | 2/2005 | Morgan et al. |
| 2005/0120508 | A1 | 6/2005 | Morgan et al. |
| 2005/0215459 | A1 | 9/2005 | Policichchio et al. |
| 2005/0217698 | A1 | 10/2005 | Mitchell et al. |
| 2005/0246849 | A1 | 11/2005 | Minkler et al. |
| 2006/0000041 | A1 | 1/2006 | Streutker et al. |
| 2006/0000050 | A1 | 1/2006 | Cipolla et al. |
| 2006/0000051 | A1 | 1/2006 | Cipolla et al. |
| 2009/0083937 | A1 | 4/2009 | Vander Baan |
| 2009/0094779 | A1 | 4/2009 | Jansen |
| 2009/0094780 | A1 | 4/2009 | Jansen |
| 2009/0151112 | A1 | 6/2009 | Jansen |
| 2010/0005613 | A1 | 1/2010 | Morgan et al. |

* cited by examiner

BARE FLOOR CLEANER

CROSS-REFERENCE TO RELATED APPLICATIONS

This application is a division of U.S. patent application Ser. No. 11/683,538, filed Mar. 8, 2007, now U.S. Pat. No. 9,125,540, issued Sep. 8, 2015, which claims the benefit of U.S. Provisional Application No. 60/743,457, filed Mar. 10, 2006, and is related to PCT Application No. PCT/US2004/026952, filed Aug. 20, 2004, published as WO2005/018402, all of which are incorporated herein by reference in their entirety.

BACKGROUND OF THE INVENTION

Field of the Invention

The invention relates to cleaning bare floor surfaces. In one aspect, the invention relates to a bare floor cleaner that selectively performs dry vacuuming and wet mopping. In another aspect, the invention relates to a bare floor cleaner wherein a dry vacuuming motor is shut off when cleaning solution is deposited on the surface to be cleaned.

Description of the Related Art

The common procedure of cleaning a bare floor surface, such as tile, linoleum, and hardwood floors, involves several steps. First, dry or loose dust, dirt, and debris are removed, and then liquid cleaning solution is applied to the surface either directly or by means of an agitator. Motion of the agitator with respect to the bare surface acts to loosen the remaining dirt. The agitator can be a stationary brush or cloth that is moved by the user, or a motor-driven brush that is moved with respect to a base support by a motor. If the agitator is absorbent, it will remove the dirt and collect a portion of the soiled cleaning solution from the floor.

Cleaning a bare floor commonly requires multiple cleaning tools. For example, the first step of removing dry debris most often employs a conventional broom and dustpan. A user sweeps dry debris into a pile and then transfers the pile to the dustpan for disposal. However, the broom and dustpan are not ideal for removing dry particles because it is difficult to transfer the entire debris pile into the dustpan. Additionally, the user typically bends over to hold the dustpan in place while collecting the debris pile. Such motion can be inconvenient, difficult, and even painful for some users. Dust cloths can also be used, but large dirt particles do not sufficiently adhere thereto. Another option is vacuuming the dry debris, but most homes are equipped with vacuum cleaners that are designed for use on carpets and can damage bare surfaces.

Tools for applying and/or agitating cleaning solution have similar deficiencies. The most common cleaning implement for these steps is the traditional sponge or rag mop. Mops are capable of loosening dirt from the floor and have excellent absorbency; however, when the mop requires more cleaning solution, it is placed in a bucket to soak up warm cleaning solution and returned to the floor. Each time more cleaning solution is required, the mop is usually placed in the same bucket, and after several repetitions the cleaning solution becomes dirty and cold. As a result, dirty cleaning solution is used to remove dirt from the bare surface. Furthermore, movement of the mop requires physical exertion, and the mop head wears with use and must be replaced periodically. Textured cloths can be used as an agitator, but they also require physical exertion and regular replacement. Additionally, cloths are not as absorbent as mops and, therefore, can leave more soiled cleaning solution on the floor.

Some household cleaning devices have been developed to eliminate the need for multiple cleaning implements for cleaning a bare floor and alleviate some of the problems described above that are associated with the individual tools. Such cleaning devices are usually adapted for vacuuming or sweeping dry dirt and dust prior to application of cleaning solution, applying and agitating the cleaning solution, and, subsequently, vacuuming the soiled cleaning solution, thereby leaving only a small amount of cleaning solution on the bare surface. Common agitators are rotating brushes, rotating mop cloths, and stationary or vibrating sponge mops. A good portion of the multifunctional cleaning devices utilize an accessory that is attached to the cleaning device to convert between dry and wet cleaning modes. Others are capable of performing all functions without accessories, but have complex designs and features that can be difficult and confusing to operate.

An example of a dry suctioning and wet mopping floor cleaner is disclosed in U.S. Patent Application Publication No. 2004/0139572 to Kisela, incorporated herein by reference in its entirety, which discloses a dry suctioning and wet mopping device wherein a solution distributor is affixed to a dry suction nozzle that is rotatable relative to a foot assembly of the device so that the dry suction nozzle can be placed in contact with or away from the surface to be cleaned at the user's discretion.

Examples of multifunctional bare floor cleaners are disclosed in U.S. Pat. Nos. 2,622,254 and 6,101,668 and in U.S. Patent Application Publication Nos. 2003/0051301, 2003/0051306, 2003/0051308, 2003/0051309, and 2003/00513010, which are incorporated herein by reference in their entirety. The '254 patent discloses an apparatus for cleaning bare and carpeted floors and comprises several independently adjustable cleaning implements, such as a squeegee attached to a suction pipe, a scrubbing roll, and a sweeping roll. The apparatus can accomplish wet pickup through the suction pipe, wet scrubbing by means of the scrubbing roll, and dry pickup with a dust collecting nozzle disposed adjacent the sweeping roll.

The publications listed in the above paragraph are a family of patent applications that disclose a bare floor cleaner having independently adjustable nozzle and brush assemblies. The nozzle assembly comprises a single nozzle opening that is surrounded by an overmolded squeegee and through which both wet and dry debris can enter. The cleaner operates in a wet pickup mode with the nozzle assembly in contact with the surface to be cleaned. The nozzle assembly is raised to a position above the surface to be cleaned for operation in a dry pickup mode.

The '668 patent is an example of a cleaner that can accomplish all the steps required to clean a bare floor with the assistance of an attachment. The cleaner has a cleaning head equipped with a nozzle having squeegees on the front and rear sides thereof and a vertically adjustable scrubbing pad through which cleaning solution can be dispensed. When a cover is attached to the bottom of the cleaning head, the entire cleaning head, including the squeegees, nozzle, and scrubbing pad, are raised from the floor to permit dry pickup.

SUMMARY OF THE INVENTION

According to one aspect of the invention, a wet/dry bare floor cleaner comprises a base, a handle pivotally connected to the base for movement between a dry mode position and a wet mode position, a recovery system for collecting dirt when the handle is in the dry mode position and comprising a motor/fan assembly mounted to one of the handle and the base, a fluid delivery system comprising a source of cleaning fluid and a fluid distributor in fluid communication with the source of cleaning fluid for dispensing cleaning fluid onto a surface to be cleaned. The recovery system includes a deactivator mechanism for deactivating the motor/fan assembly when the fluid distributor is dispensing cleaning fluid onto the surface to be cleaned.

Further according to another aspect of the invention, a wet/dry bare floor cleaner comprises a base, a handle pivotally connected to the base for movement between a dry mode position and a wet mode position, a recovery system for collecting dirt when the handle is in the dry mode position, and a fluid delivery system comprising a source of cleaning fluid and a fluid distributor in fluid communication with the source of cleaning fluid for dispensing cleaning fluid onto a surface to be cleaned. The recovery system includes a disabling mechanism for disabling the recovery system when the fluid distributor is dispensing cleaning fluid onto the surface to be cleaned.

DESCRIPTION OF THE PREFERRED EMBODIMENT

Figure 1:
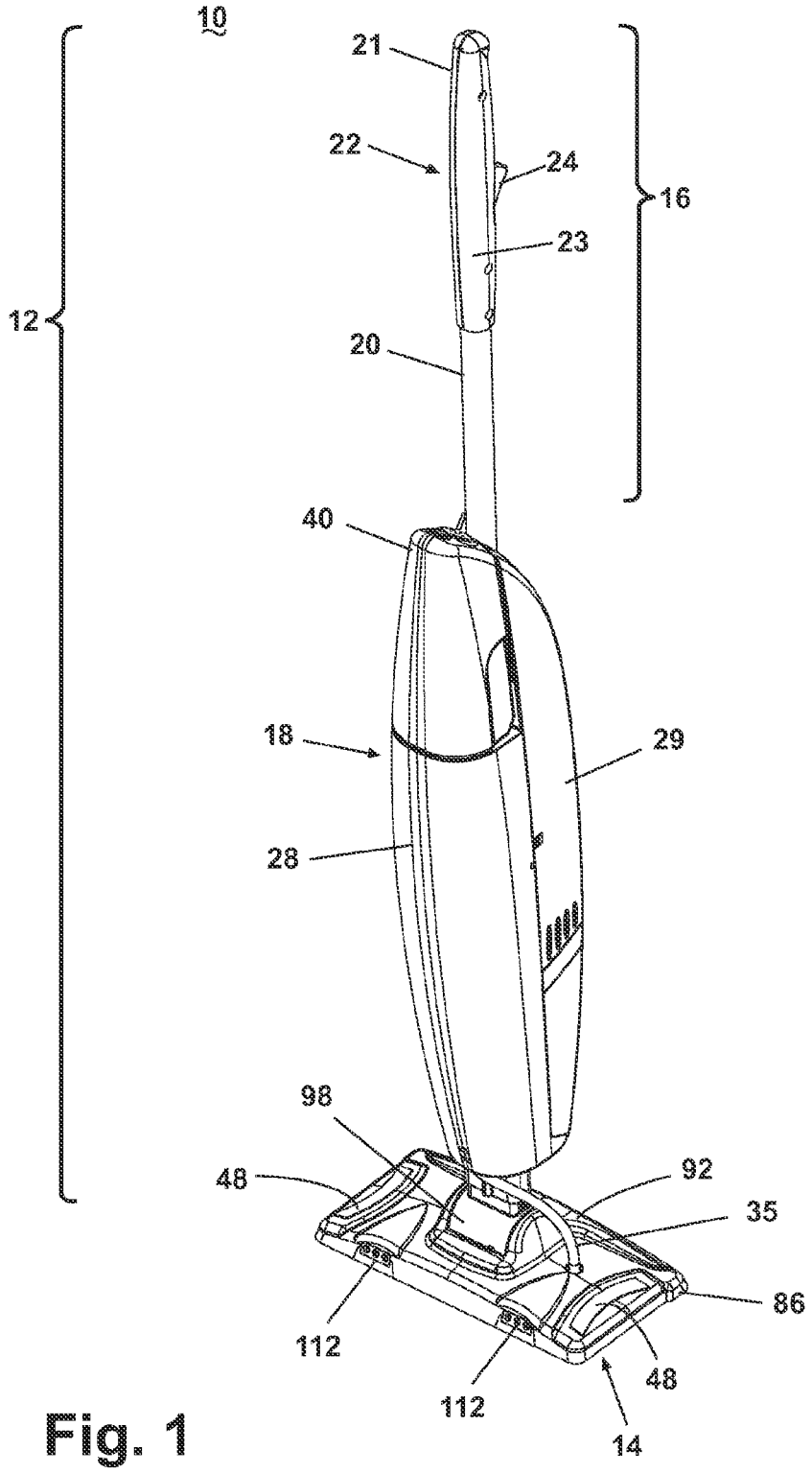
FIG. 1 is a perspective view of a bare floor cleaner according to the invention, comprising a foot assembly and a handle assembly.
Figure 2:
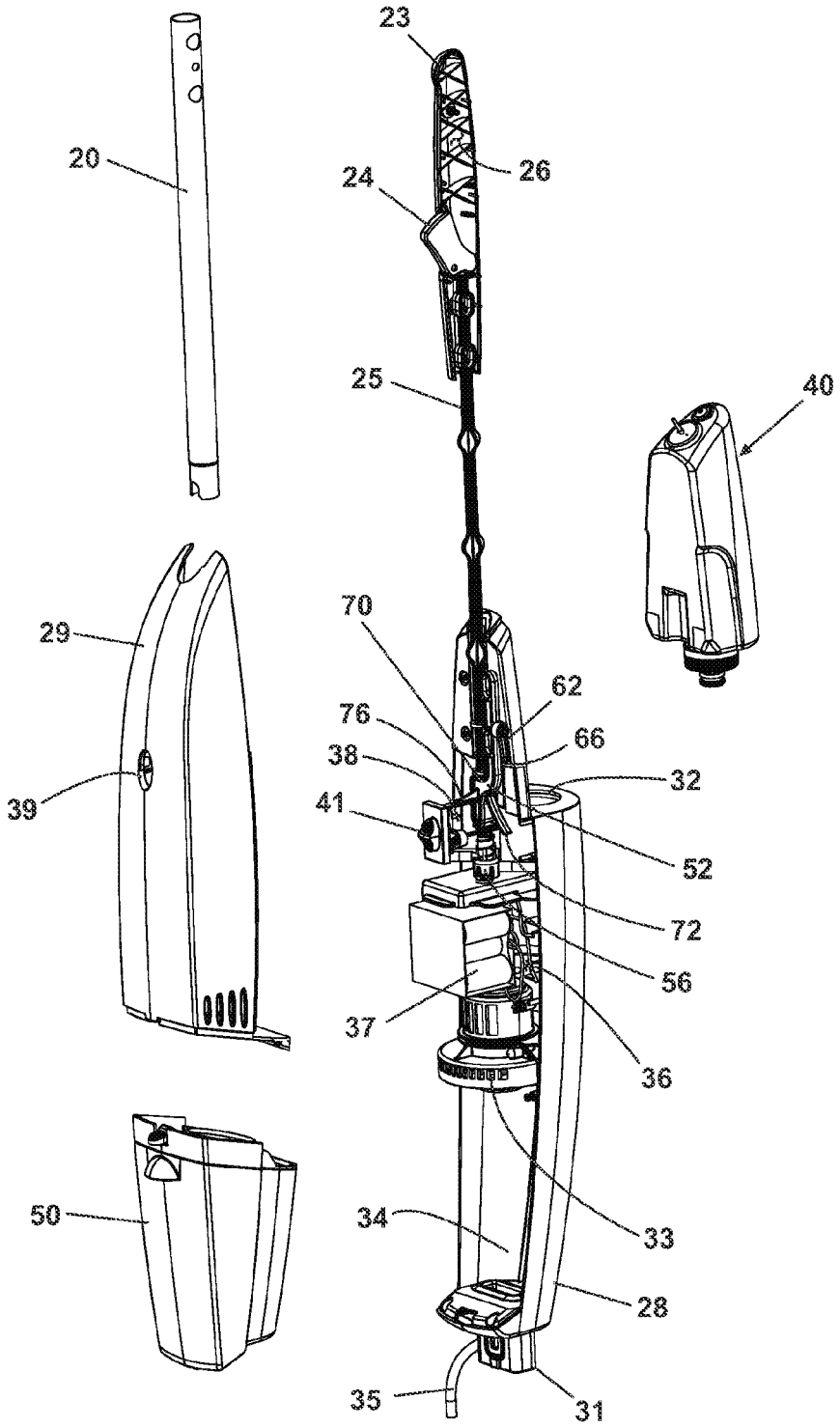
FIG. 2 is an exploded perspective view of the bare floor cleaner handle assembly shown in FIG. 1.

Referring to the drawings and to FIGS. 1 and 2 in particular, a bare floor cleaner 10 according to the invention comprises a handle assembly 12 pivotally mounted to a base or foot assembly 14. The handle assembly 12 can pivot from an upright or vertical position, where the handle assembly 12 is substantially vertical relative to a surface to be cleaned, to either a first or second lowered position, whereby the handle assembly 12 is respectively moved in an forward or rearward direction relative to the foot assembly 14 and is angled relative to the surface to be cleaned.

The handle assembly 12 comprises an upper handle assembly 16 and a lower handle assembly 18. The upper handle assembly 16 comprises a hollow handle tube 20 having a grip assembly 22 fixedly attached to a first end of the handle tube 20 and the lower handle assembly 18 fixedly attached to a second end of the handle tube 20 via screws or other suitable commonly known fasteners. The grip assembly 22 is essentially an elongated handle shaft that is gripped by the user by wrapping one hand around the shaft; however, it is within the scope of the invention to utilize other grips commonly found on other machines, such as closed-loop grips having circular or triangular shapes. The grip assembly 22 comprises a right handle half 21 that mates with a left handle half 23 and provides a user interface to manipulate the bare floor cleaner 10. Additionally, the mating handle halves 21, 23 form a cavity 26 therebetween. Referring to FIG. 2, wherein the right handle half 21 of the grip assembly 22 is removed for illustrative purposes, a trigger 24 is partially mounted within the cavity 26, with a portion of the trigger 24 projecting outwardly from the grip assembly 22 where it is accessible to the user. The remainder of the trigger 24 resides in the cavity 26 formed by the handle halves 21, 23 and communicates with a push rod 25 that is positioned within the hollow interior of the handle tube 20. The trigger 24 is pivotally mounted to the handle halves 21, 23 so that the trigger 24 can rotate relative to the grip assembly 22 in a conventional manner.

The lower handle 18 comprises a generally elongated rear enclosure 28 that provides structural support for components of the bare floor cleaner 10 contained therein. A front enclosure 29 mates with the rear enclosure 28 to form a central cavity 36 therebetween. A first recess 32 is formed above the rear enclosure 28 and a second recess 34 is formed below the front enclosure 29. A lower end of the lower handle assembly 18 comprises a generally rectangular conduit 31 that defines a working air inlet to the handle assembly 12 and is in fluid communication with the foot assembly 14.

A dirt bin assembly 50 is removably mounted in the second recess 34. The dirt bin assembly is preferably constructed, at least partially, of a translucent material. A suitable dirt bin assembly is more fully described in PCT Application No. PCT/US2004/026952, which is incorporated herein by reference in its entirety. The dirt bin assembly 50 is in fluid communication with the conduit 31 when it is mounted in the second recess 34 such that working air from the foot assembly 14 is drawn through the dirt bin assembly 50 by a motor/fan assembly 33. Dry debris entrained in the working air will be separated and collected by the dirt bin assembly 50.

The motor/fan assembly 33 is mounted in the cavity 36, and is vertically located between the first recess 32 and the second recess 34. The motor/fan assembly 33 creates airflow in a conventional manner, which moves debris from the surface being cleaned into the cleaner 10. The motor/fan assembly 33 is powered by a commonly known rechargeable battery pack 37 that is also located within the cavity 36. The battery pack 37 is selectively connected to the motor/fan assembly 33 through an electrical on/off switch 38 operable through a switch aperture 39 in the front enclosure 29 via a switch button 41. Alternatively, the motor/fan assembly 33 can be mounted to the foot assembly 14 in a commonly known fashion.

Figure 3:
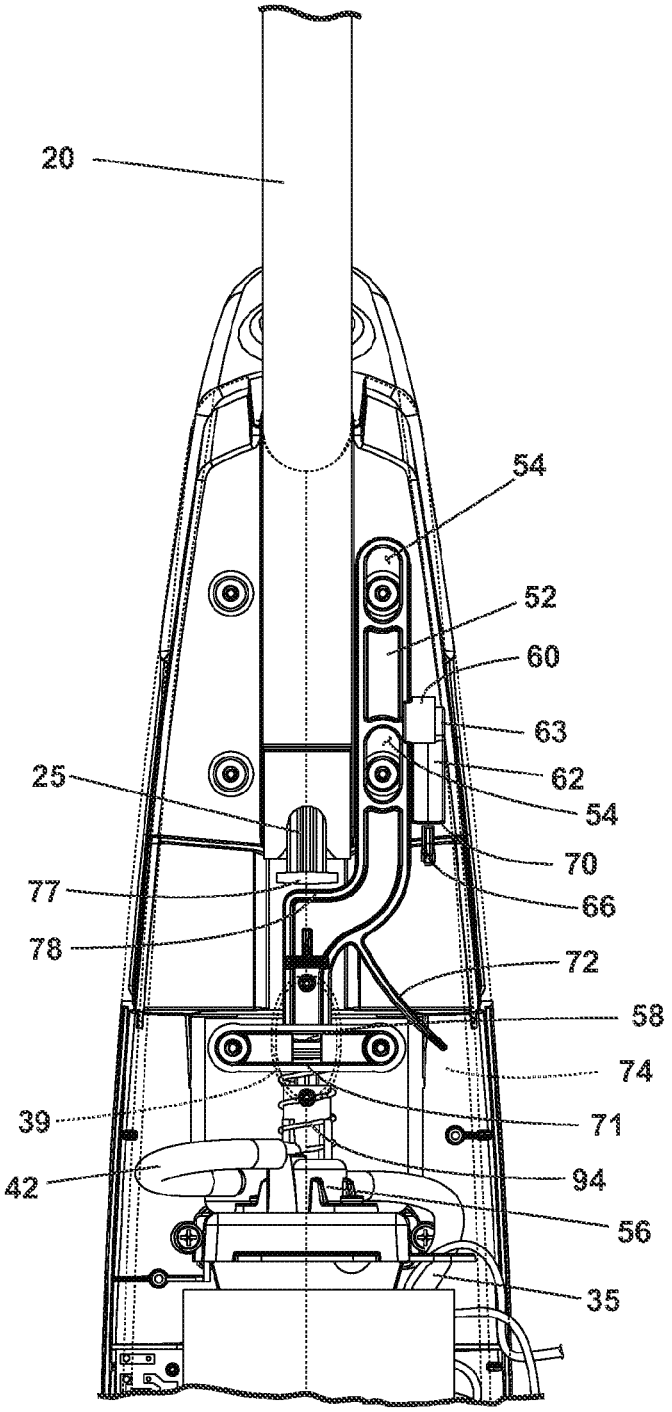
FIG. 3 is a partial front view of a lower portion of the handle assembly of the bare floor cleaner shown in FIG. 1 with a front enclosure removed for clarity.
Figure 4:
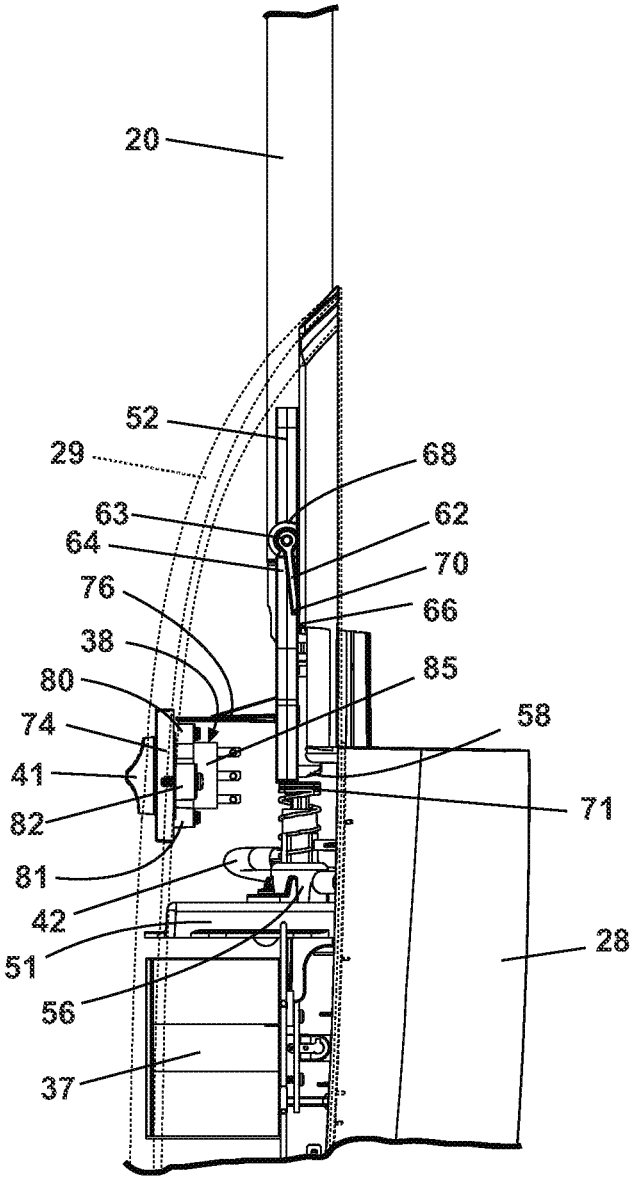
FIG. 4 is a side view of the lower portion of the handle assembly shown in FIG. 3.

Referring to FIGS. 3 and 4, the lower handle assembly 18 further comprises a transfer rod 52 that is slidably secured therein via a pair of cutouts 54 surrounding corresponding screw bosses that partially secure the rear enclosure 28 to the front enclosure 29. A solution valve assembly 56 is fixedly mounted in spaced relation to a valve assembly engagement surface 58 on one end of the transfer rod 52. A trigger stop pivot 60, located adjacent to the cutouts 54, extends from a side surface of the transfer rod 52 and pivotally mounts a trigger stop 62 on a pin 63 extending therefrom. A mechanical stop 64 is located on the trigger stop pivot 60 to limit rotational movement of the trigger stop 62. A stop rib 66 is integrally formed on the rear enclosure 28 in close proximity to one end of the trigger stop 62. A resilient spring arm 72 protrudes from a side surface of the transfer rod 52, and the free end of the spring arm 72 engages with a corresponding spring support 74 integrally formed in the rear enclosure 28. The spring support 74 can further be a screw boss used to secure the rear enclosure 28 to the front enclosure 29. The trigger stop 62 further comprises a bearing surface 68 that rotates about the pin 63 as well as a stop rib engagement surface 70 that makes selective contact with the stop rib 66 depending upon the orientation of the handle assembly 12 relative to foot assembly 14 as will be discussed in more detailed herein.

Figure 5:
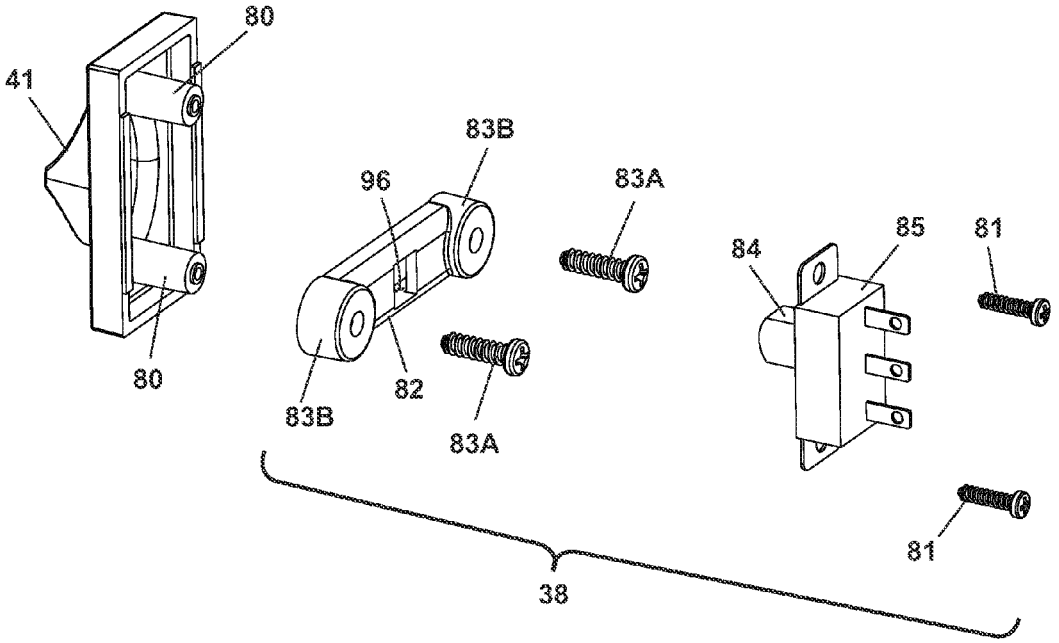
FIG. 5 is an exploded view of a switch assembly of the base floor cleaner.

Referring to FIGS. 4 and 5, a rigid switch interface arm 76 extends orthogonally from a front face of the transfer rod 52 and selectively engages an upper surface of the switch button 41. The switch button 41 further comprises a pair of switch button bosses 80 to which the on/off switch 38 is attached by a pair of screws 81. Specifically, the on/off switch 38 comprises a commonly known switch body 85 containing a slideable switch actuator 84 that can be moved by the user to open or close the electrical circuit. The switch body 85 is fixedly attached to the bosses 80 of the switch button 41 for movement therewith. This configuration holds the switch actuator 84 stationary while the switch body 85 is moved. The switch button 41 therefore controls the position of the switch actuator 84 since the switch button 41 is directly coupled to the switch body 85. The switch interface arm 76 is dimensioned so that a portion overlaps the upper switch button boss 80. A switch bridge 82 is rigidly attached to an inside surface of the front enclosure 29 via a pair of screws 83A received in screw bosses 83B. The switch bridge 82 further comprises a generally central aperture 96 that receives the switch actuator 84.

Figure 6:
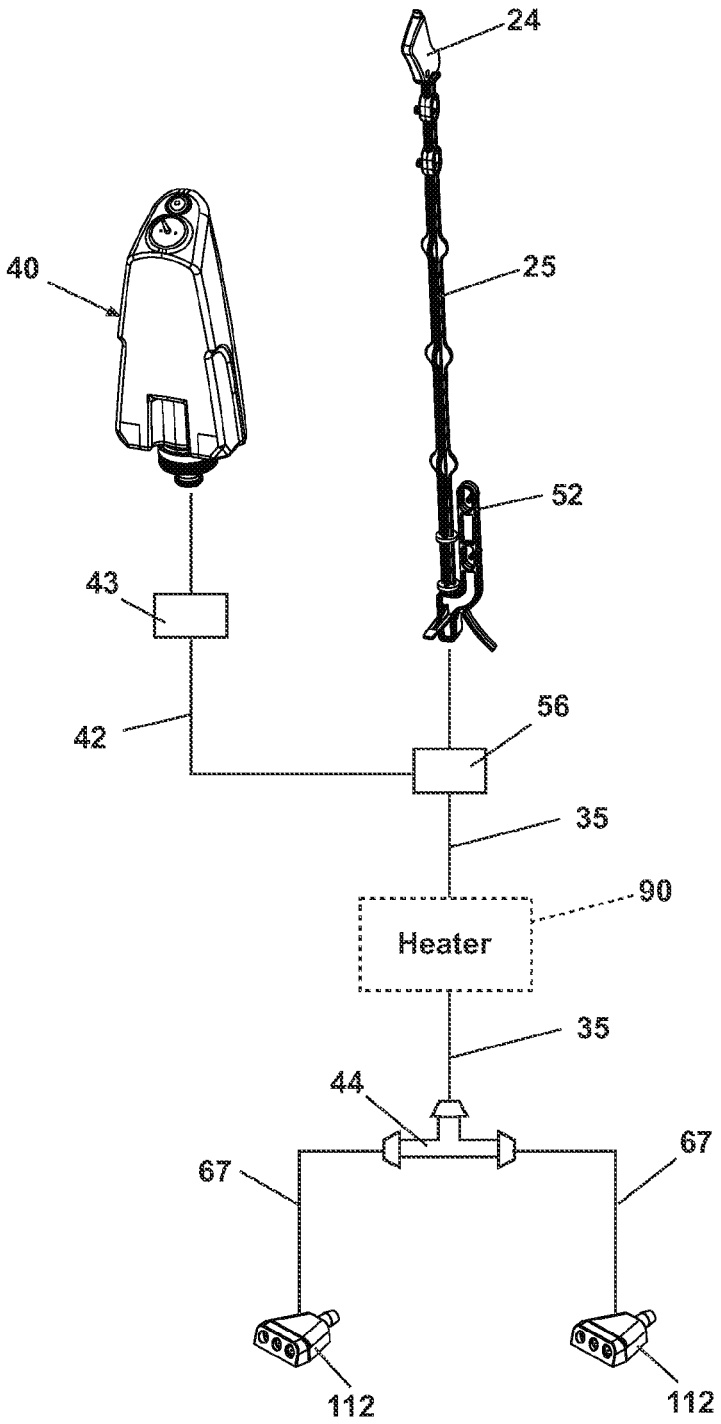
FIG. 6 is a schematic diagram of a solution delivery system of the bare floor cleaner shown in FIG. 1.

Referring to FIGS. 2 and 6, a solution tank assembly 40 is removably mounted to the lower handle 18 such that it partially rests on the rear enclosure 28 and is partially received by the first recess 32. The solution tank assembly 40 comprises a tank to hold a predetermined amount of cleaning solution which comprises a liquid, such as water, cleaning detergent, or a mixture thereof. As shown schematically in FIG. 6, when the solution tank assembly 40 is mounted to the lower handle 18, it is in fluid communication with a commonly known receiver 43. A first solution conduit 42 fluidly communicates between the receiver 43 and a solution valve assembly 56. A second solution conduit 35 fluidly communicates between an outlet of the solution valve assembly 56 and a solution tee 44 located in the foot assembly 14 as will be described in more detail below. Each of a pair of distribution conduits 67 fluidly communicates between the solution tee 44 and a corresponding pair of solution distributors 112. Optionally, a heating element 90 can be provided between the solution valve assembly 56 and the fluid distributors 112 to heat the cleaning solution prior to distribution onto the surface to be cleaned as is more fully disclosed in U.S. Pat. No. 6,131,237 which is incorporated herein by reference in its entirety. The heating element 90 can be powered through the battery pack 37 in a commonly known manner. A suitable solution tank assembly and fluid distribution system is more fully described in the above referenced '952 PCT application.

Figure 7:
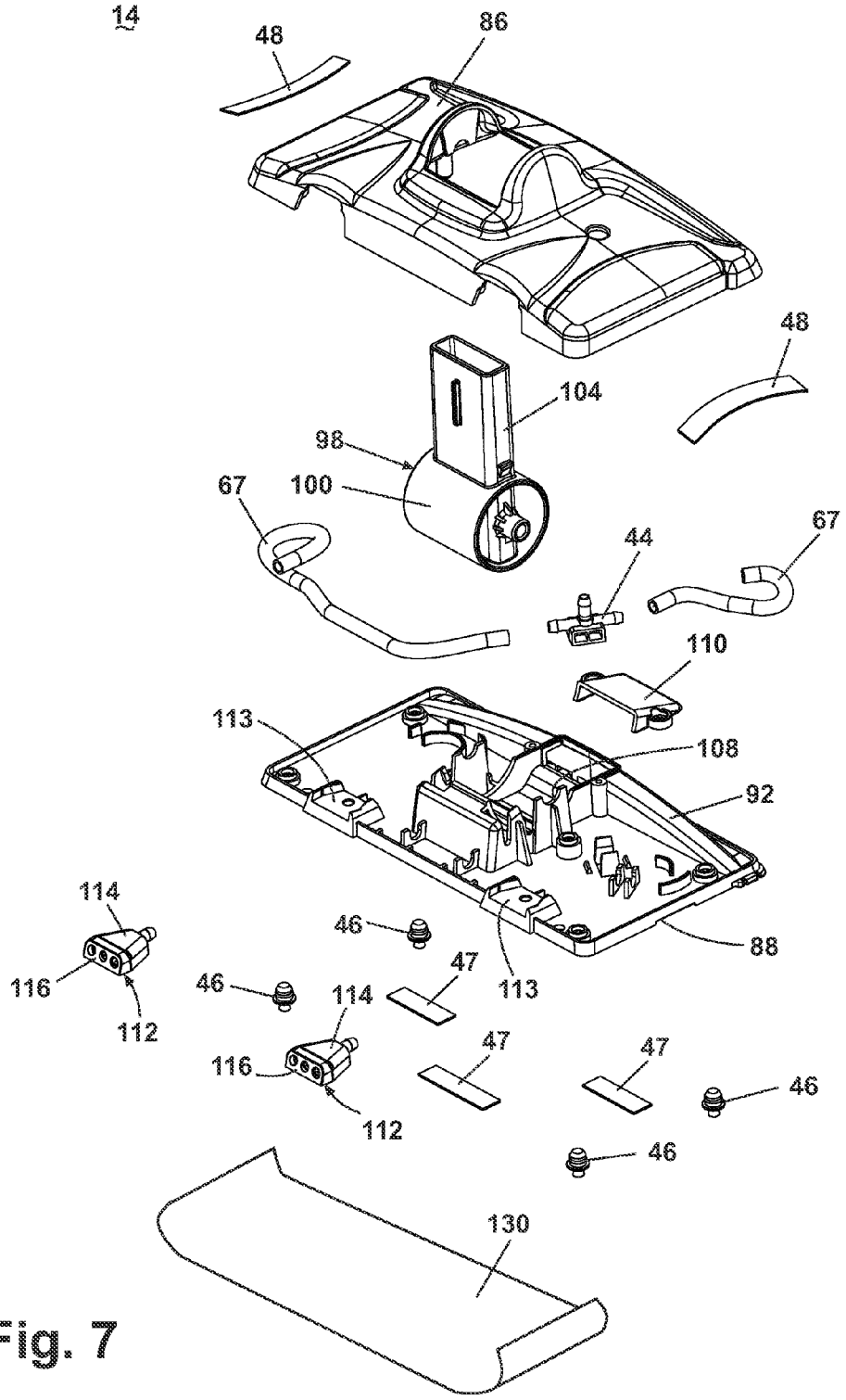
FIG. 7 is an exploded view of the foot assembly of the bare floor cleaner shown in FIG. 1.

Referring to FIG. 7, the foot assembly 14 comprises a top enclosure 86 mounted to a base platform 88 to define therebetween a cavity that houses several components of the foot assembly 14. The base platform 88 provides structural support for several of the foot assembly components, including a handle pivot 98, the solution distributors 112, solution conduits 67, solution tee 44, a plurality of support glides 46, a plurality of lower pad attachment devices 47, and a pair of upper pad attachment devices 48. The base platform 88 also forms an integral dry suction nozzle 92 near one edge thereof.

The handle pivot 98 pivotally mounts the handle assembly 12 to the foot assembly 14 and comprises a barrel 100 with a longitudinal inlet aperture 102 formed in a sidewall thereof to create a working air path from the dry suction nozzle 92 to the dirt bin assembly 50 through a conduit 104 that is integrally formed with the barrel 100. The conduit 104 is in fluid communication with conduit 31 and can be at least partially received within conduit 31. A suitable handle pivot is more fully described in the above referenced '952 PCT application.

A working air passage 106 is substantially integrally formed between the dry suction nozzle 92 and the handle pivot 98. However, to simplify the manufacturing process, the base platform 88 can also accept individual pieces such as a working air cap 110 to complete the working air passage 106. One advantage of incorporating removable parts into the working air path is that access can be gained to the air path for cleaning out occasional clogs.

Figure 8:
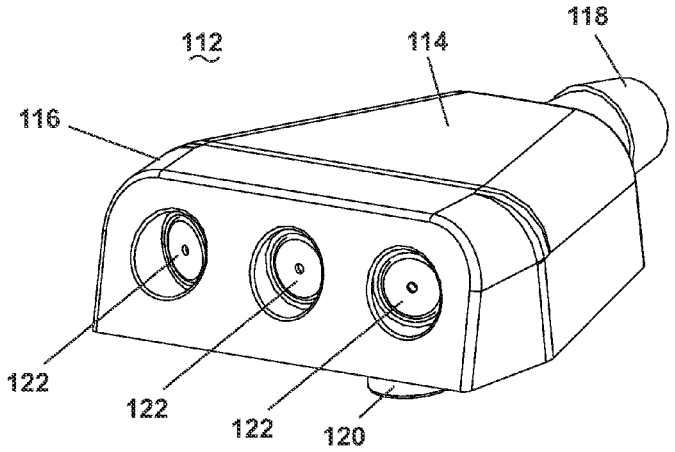
FIG. 8 is a perspective view of a fluid distributor shown in FIG. 7.

Referring to FIG. 8, the solution distributors 112 each comprise a hollow body 114 mated to an outlet manifold 116. The hollow body 114 further comprises a conduit barb 118 to fluidly communicate with the aforementioned solution conduits 67. The outlet manifold 116 further comprises a plurality of orifices 122 to deliver solution to the surface to be cleaned. The orifices 122 can be angled relative to each other so that fluid distribution can be spread in any desired pattern, such as a fan-shaped pattern. A solution conduit 67 is attached to the conduit barb 118 on one end. The other end of the solution conduit 67 is attached to a conduit barb on the solution tee 44, placing the solution distributors 112 and the solution tee 44 in fluid communication. The solution distributors 112 are securely positioned in corresponding recesses 113 in the base platform 88 by a mounting feature 120 that extends from the hollow body 114, and are oriented on a side of the foot assembly 14 opposite the dry suction nozzle 92.

Figure 9A:
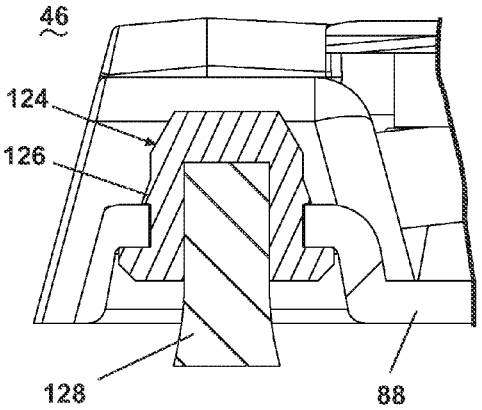
FIG. 9A is a sectional view of a support glide shown in FIG. 7.

Referring to FIG. 9A, the support glides 46 are secured to the base platform 88 and comprise a retaining portion 124, a retaining wall 126, and a support surface 128. The support surface 128 can comprise a plurality of support bristles. The retaining portion 124 is secured to the base platform 88 by pushing the retaining portion 124 through a corresponding aperture in the base platform 88 so that the retaining wall 126 deforms as it passes through the aperture and snaps into place. The support surface 128 protrudes beneath the base platform 88 so that the weight of the bare floor cleaner 10 is supported solely through the support glides 46. This minimizes the surface area contact between the bare floor cleaner 10 and the surface to be cleaned, resulting in lower frictional forces and easing the push force required to be supplied by the user as the foot assembly 14 is moved across the surface to be cleaned.

Referring to FIG. 7, the lower pad attachment devices 47 are located on a bottom surface to the base platform 88 and the upper pad attachment devices 48 are located on a top surface of the top enclosure 86. The attachment devices 47, 48 are preferably made of the hook portion of a commonly known hook and loop fastener material, such as Velcro®, and are secured to the base platform 88 and top enclosure 86 with adhesive. A mop cloth 130 is wrapped over the support glides 46 (FIG. 9) and secured to the foot assembly 14 via the pad attachment devices 47, 48.

Figure 9B:
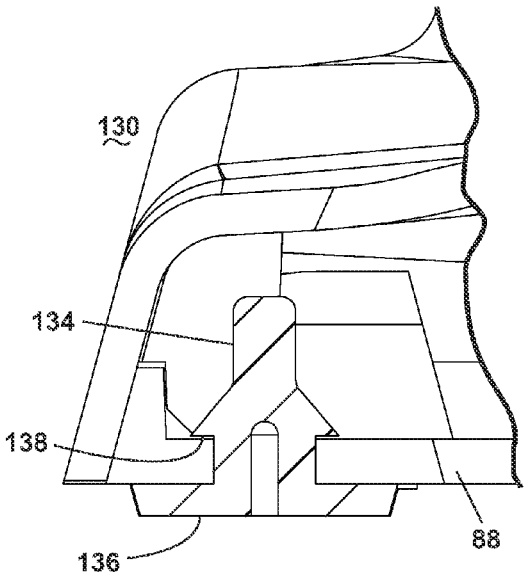
FIG. 9B is a sectional view of an optional pad for the foot assembly.

Referring to FIG. 9B, optional non-skid pads 132 can be secured to the base platform 88 in place of or in addition to the support glides 46 to achieve a different result. The pads 132 comprise a retaining portion 134 and a support portion 136. The retaining portion 134 has a retaining wall 138 and is secured to the base platform 88 by pushing the retaining portion 134 through a corresponding aperture in the base platform 88 so that the retaining wall 138 deforms as it passes through the aperture and snaps into place. The support portion 136 protrudes beneath the base platform 88 so that the weight of the bare floor cleaner 10 is supported solely through the non-skid pads 132. The non-skid pads 132 are typically made of a rubber or elastomeric material that has a high coefficient of friction and provide a high friction surface area contact between the bare floor cleaner 10 and the surface to be cleaned, increasing the push force required to be supplied by the user as the foot assembly 14 is moved across the surface to be cleaned. The non-skid pads 132 discourage use of the bare floor cleaner 10 when no mop cloth 130 is present, thus minimizing the possibility of the bare foot assembly 14 causing damage to the surface to be cleaned.

Figure 10:
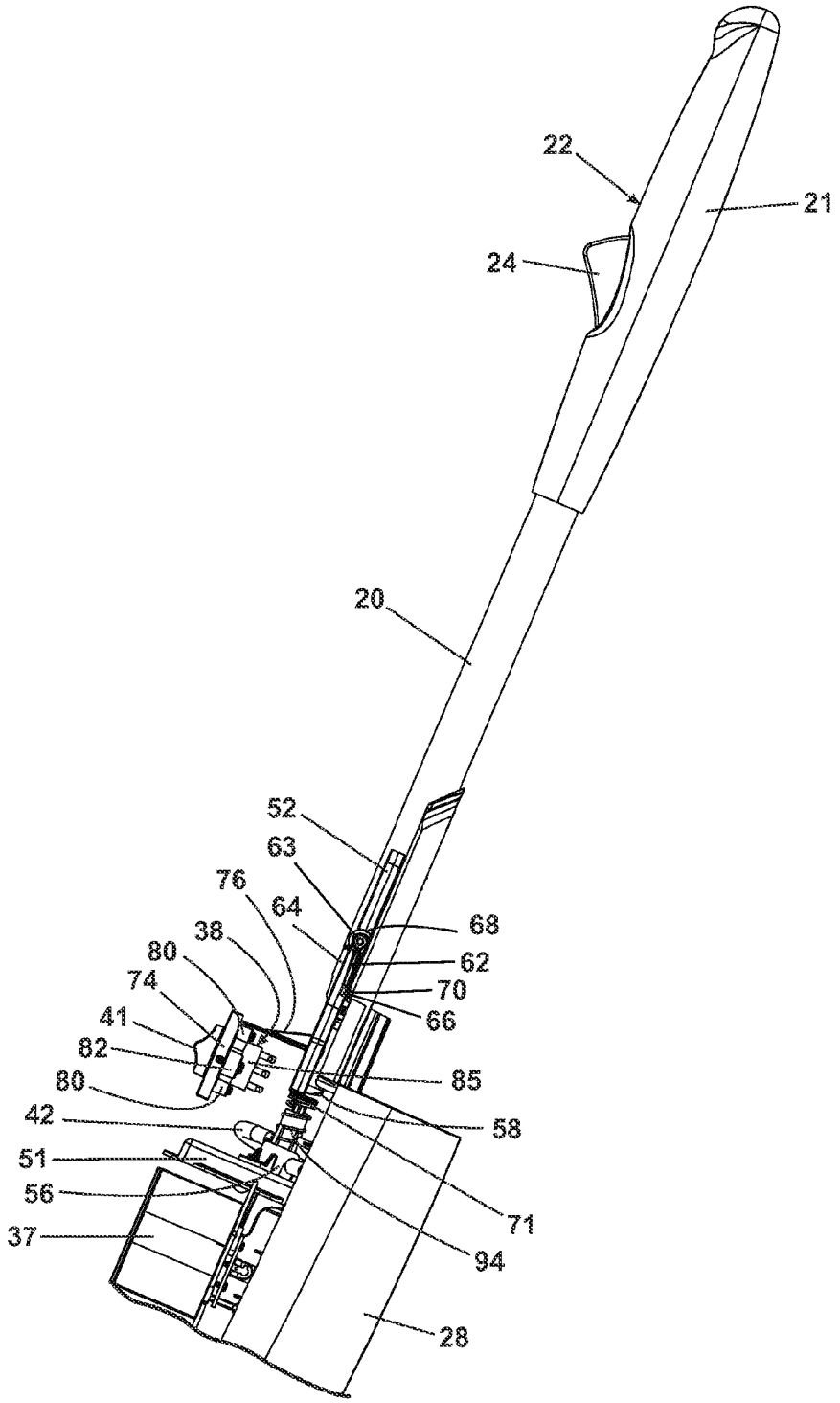
FIG. 10 is a partial view of the handle assembly of the bare floor cleaner of FIG. 1, illustrated in a dry suction mode configuration.
Figure 11:
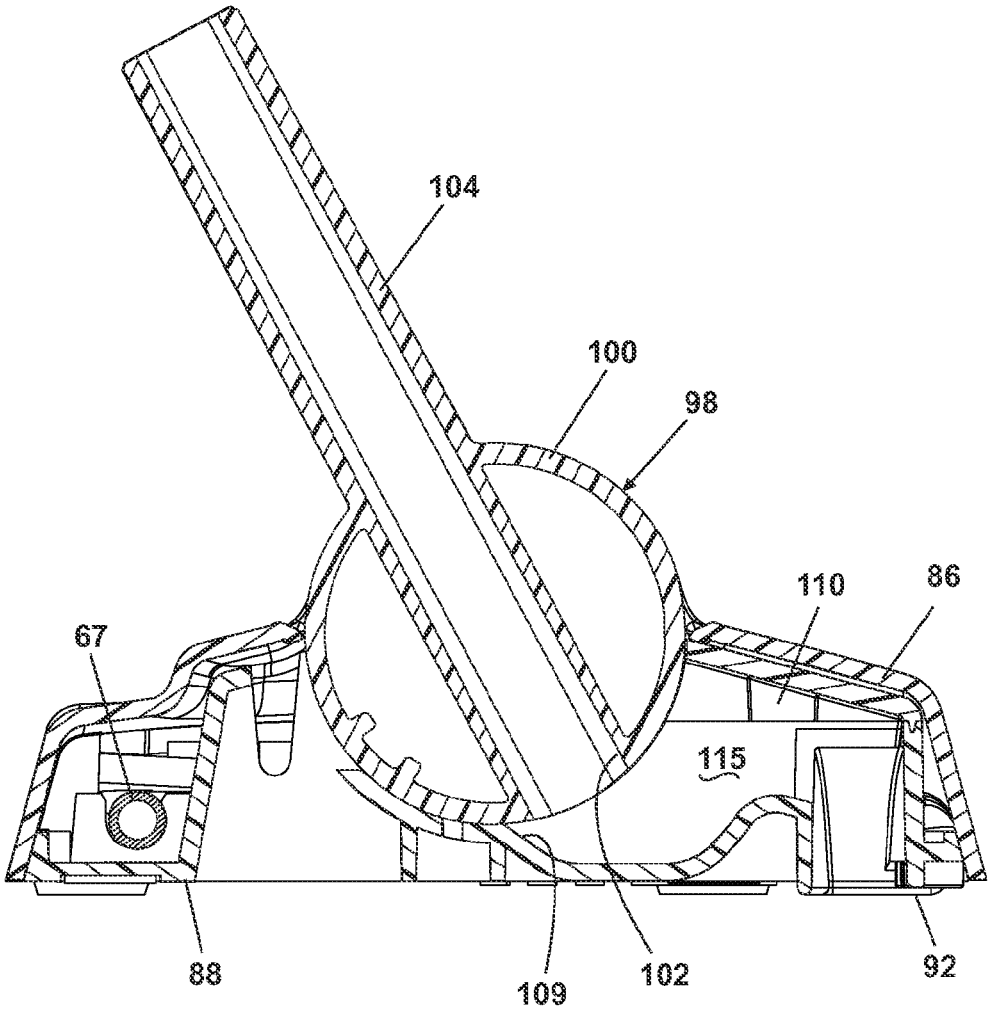
FIG. 11 is a sectional view of the foot assembly of the bare floor cleaner of FIG. 1, illustrated in the dry suction mode configuration.

The bare floor cleaner 10 can be selectively operated in a dry suction mode, in which dry dirt and debris from the surface to be cleaned is collected in the dirt bin assembly 50 via the dry suction nozzle 92, or a wet mopping mode, in which solution is distributed onto the surface to be cleaned from the solution distributors 112 and scrubbed using the mop cloth 130. Referring to FIGS. 10 and 11, the dry suction mode is described wherein the handle assembly 12 is in a first lowered position, in which the handle assembly 12 is generally oriented over the solution distributors 112 such that the dry nozzle assembly 92 is positioned ahead of the handle assembly 12 relative to the solution distributors 112. In this position, the trigger 24 is oriented on an upper portion of the grip assembly 22 and out of convenient reach of the user. The inlet aperture 102 of the handle pivot 98 is aligned with an aperture 109 in a pivot cradle 108 formed in the base platform 88. As a result, a working air path extends from the dry nozzle assembly 92, through space 115 between the base platform 88 and the working air cap 110, through the conduit 104 that projects from the pivot barrel 100, and through conduit 31 to an inlet of the dirt bin assembly 50. A suitable air path is more fully described in the above referenced '952 PCT application The motor/fan assembly 33 can be activated and de-activated by the user via the switch button 41. The switch button 41 position, and hence whether the motor/fan assembly 33 is activated or deactivated, can be changed by the user regardless of the handle orientation.

No solution is intended to be distributed during dry suction mode. As previously mentioned, the trigger 24 is out of convenient reach of the user to minimize activation. Furthermore, with the handle assembly 12 in the first lowered position, the trigger stop 62 rotates about the pin 63 under force of gravity and comes to rest on the inside wall of the rear enclosure 28 in close proximity to the trigger stop rib 66. Therefore, even if the trigger 24 is inadvertently engaged by the user, the trigger stop 62 prevents the transfer rod 52 from moving.

Figure 12:
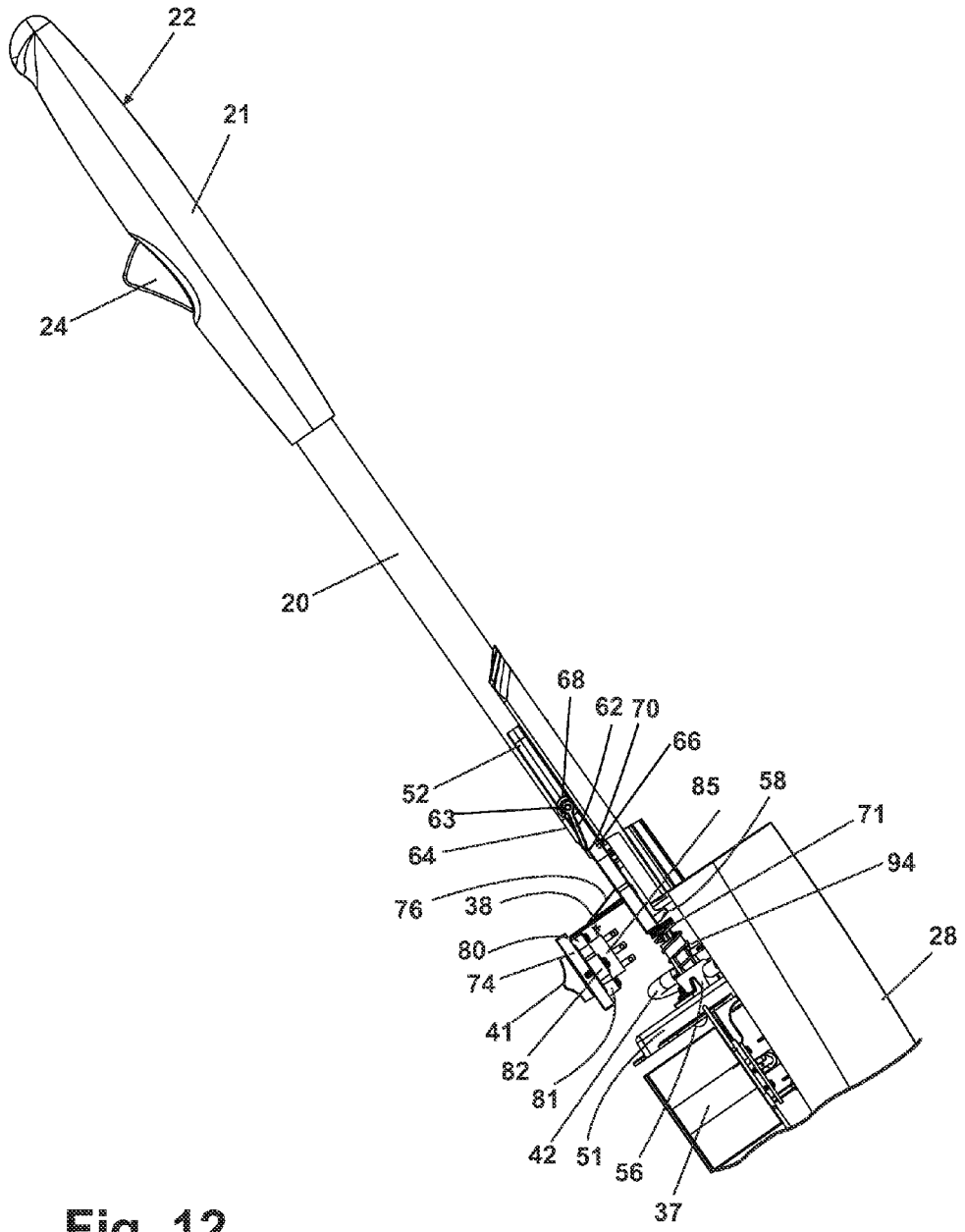
FIG. 12 is a partial view of the handle assembly of the bare floor cleaner of FIG. 1, illustrated in a wet mop mode configuration.
Figure 13:
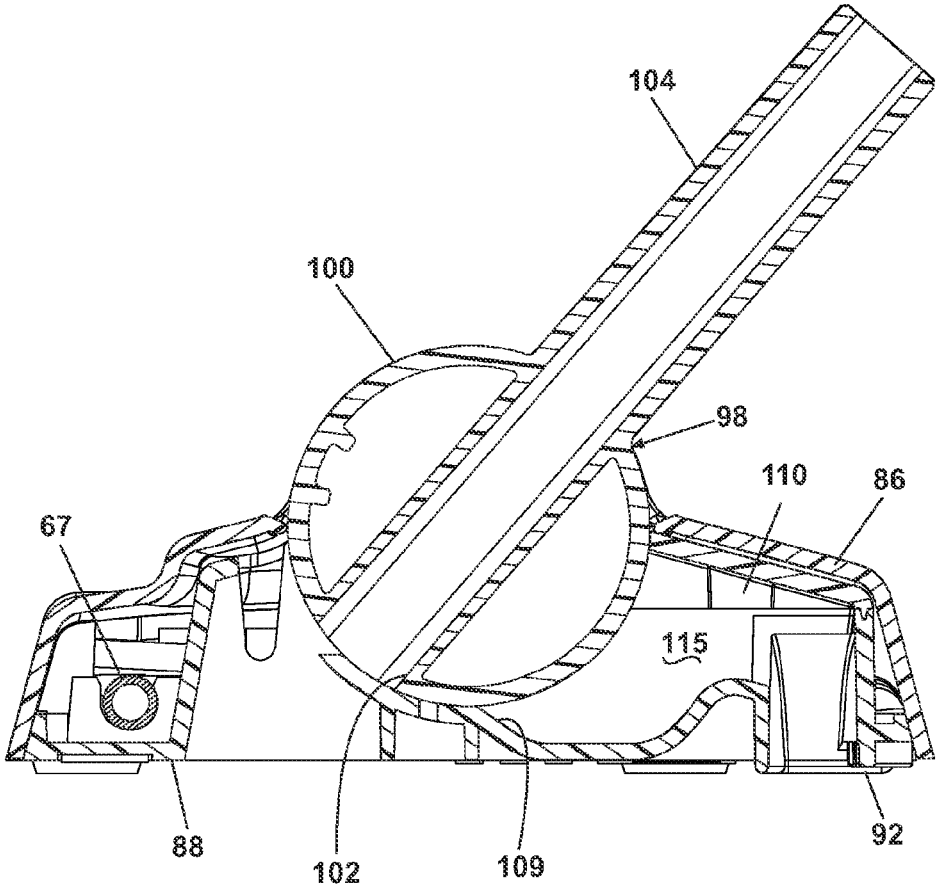
FIG. 13 is a sectional view of the foot assembly of the bare floor cleaner of FIG. 1, illustrated in the wet mop mode configuration.

Referring now to FIGS. 12 and 13, a wet mop mode is described wherein the handle assembly 12 is in a second lowered position, in which the handle assembly is generally oriented over the dry nozzle assembly 92 such that the solution distributors 112 are positioned ahead of the dry nozzle assembly 92 relative to the handle assembly 12. When the handle assembly 12 is in the second lowered position, the barrel 100 blocks the aperture 109 and no air is drawn into the dirt bin assembly 50.

When the handle assembly 12 is in second lowered position, the trigger 24 is on an underside of the grip assembly 22 and within convenient reach of the user. Referring to FIG. 12 and the schematic in FIG. 6, cleaning solution can be selectively dispensed from the solution tank assembly 40 via depression of the trigger 24, which engages the push rod 25. As the push rod 25 moves, an engagement surface 77 on one end of the push rod 25 contacts a push rod engagement surface 78 on the transfer rod 52. Since the handle assembly 12 is inclined, the trigger stop 62 falls, under the force of gravity, away from the stop rib 66 and comes to rest on the mechanical stop 64 on the transfer rod 52. With the trigger stop 62 in this position, the transfer rod 52 can move in response to the force from the push rod 25, whereby the solution valve assembly engagement surface 58 contacts a transfer rod engagement surface 71 on the solution valve assembly 56, thus opening the solution valve assembly 56. Subsequently, cleaning solution flows by gravitational feed from the solution tank assembly 40 sequentially through the receiver 43, through the solution conduit 42, through the now open solution valve assembly 56, through the second solution conduit 35, through the solution tee 44, through the distribution conduits 67, and finally to the fluid distributors 112, where cleaning solution is dispensed in the desired pattern onto the surface to be cleaned.

Referring to FIGS. 5, 12, and 13, movement of the transfer rod 52 further causes the spring arm 72 to deflect against the spring support 74, creating an opposing force to the trigger 24 and tending to return the transfer rod 52 to an at rest position. Additionally, as the transfer rod 52 moves, the switch interface arm 76 contacts the upper switch button boss 80 forcing the switch button 41 and switch body 85 down. As the switch body 85 moves down, the switch actuator 84 is held stationary by the switch bridge 82, thus moving the on/off switch from an "on" position to an "off" position. Therefore, with the cleaner 10 in the wet mop mode, cleaning solution can be applied to the surface to be cleaned and the motor/fan assembly 33 is automatically turned off. It is desirable to turn off the motor/fan assembly 33 during the wet mode because the dirt bin assembly 50 of the cleaner 10 is not designed to perform wet extraction and the battery life of the cleaner 10 can be extended.

When the trigger 24 is released, the spring arm 72 biases the transfer rod 52 back to the normal position, a spring 94 on the solution valve assembly 56 closes the solution valve assembly 56 and the flow of cleaning solution from the solution tank assembly 40 is stopped. The user can then move the foot assembly 14 over the dispensed cleaning solution and use the mop cloth 130 to agitate debris on the surface and absorb excess cleaning solution. The motor/fan assembly 33 remains deactivated and will remain so until the user manually actuates the switch button 41. Since the weight of the bare floor cleaner 10 is fully supported by the support glides 46, surface contact between the bare floor cleaner 10 and the surface to be cleaned is minimized and friction is reduced, resulting in a low push force required to manipulate the bare floor cleaner 10. Since the support glides 46 are always indirectly in contact with the surface to be cleaned through the mop cloth 130, lower push forces are encountered in both the wet mop and dry suction modes.

While the invention has been specifically described in connection with certain specific embodiments thereof, it is to be understood that this is by way of illustration and not of limitation. Reasonable variation and combination are possible with the scope of the foregoing disclosure without departing from the spirit of the invention, which is defined in the appended claims.

What is claimed is:

1. A wet/dry bare floor cleaner, comprising:

a base;

a handle pivotally connected to the base for movement between a dry mode position and a wet mode position;

a recovery system for collecting dirt when the handle is in the dry mode position and comprising a motor/fan assembly carried by one of the handle and the base; and a fluid delivery system comprising a source of cleaning fluid and a fluid distributor in fluid communication with the source of cleaning fluid for dispensing cleaning fluid onto a surface to be cleaned;

wherein the recovery system includes a deactivator mechanism adapted to deactivate the motor/fan assembly when the fluid distributor is dispensing cleaning fluid onto the surface to be cleaned, wherein the fluid delivery system includes a disabling mechanism adapted to disable the recovery system when the fluid distributor is dispensing cleaning fluid onto the surface to be cleaned.

2. The wet/dry bare floor cleaner from claim 1, wherein the deactivator mechanism includes a switch that controls the supply of electrical energy to the motor/fan assembly.

3. The wet/dry bare floor cleaner from claim 2, wherein the disabling mechanism includes a trigger operably coupled with the fluid delivery system, whereby cleaning fluid can be dispensed from the source of cleaning fluid by depression of the trigger, and wherein the trigger is further operably connected to the switch such that the motor/fan assembly is automatically deactivated when the trigger is pressed.

4. The wet/dry bare floor cleaner from claim 3, wherein the handle comprises a hand grip, and the trigger is positioned on one side of the hand grip for convenient operation by a finger of a user in the wet mode position and for inconvenient operation by the finger of the user in the dry mode position.

5. The wet/dry bare floor cleaner from claim 4, wherein the handle is at an acute angle with respect to the vertical in a first direction in the dry mode position and the handle is at an acute angle with respect to the vertical in a second direction in the wet mode position.

6. The wet/dry bare floor cleaner from claim 1 and further comprising a suction nozzle on the base.

7. The wet/dry bare floor cleaner from claim 6, wherein the recovery system includes a diverter valve movable between an open position when the handle is in the dry mode position and a closed position when the handle is in a wet mode position, wherein the motor/fan assembly is blocked from fluid communication with the suction nozzle when the diverter valve is in the closed position.

8. The wet/dry bare floor cleaner from claim 6, wherein the suction nozzle is positioned on one side of the base and the fluid distributor is positioned on another side of the base.

9. The wet/dry bare floor cleaner from claim 8 and further comprising a cleaning pad mounted to an underside of the base.

10. The wet/dry bare floor cleaner from claim 8, wherein the fluid distributor includes a spray nozzle for projecting cleaning fluid onto the surface.

11. The wet/dry bare floor cleaner from claim 1 and further comprising a heating element to raise the temperature of the cleaning fluid to be dispensed to the surface to be cleaned.

12. A wet/dry bare floor cleaner, comprising:

a base;

a handle pivotally connected to the base for movement between a dry mode position and a wet mode position;

a recovery system for collecting dirt when the handle is in the dry mode position; and a fluid delivery system comprising a source of cleaning fluid and a fluid distributor in fluid communication with the source of cleaning fluid for dispensing cleaning fluid onto a surface to be cleaned;

wherein the fluid delivery system includes a disabling mechanism adapted to disable the recovery system when the fluid distributor is dispensing cleaning fluid onto the surface to be cleaned.

13. The wet/dry bare floor cleaner from claim 12, wherein the recovery system comprises a motor/fan assembly carried by one of the handle and the base, and a deactivator mechanism coupled to the motor/fan assembly to deactivate the motor/fan assembly when fluid is being dispensed.

14. The wet/dry bare floor cleaner from claim 13, wherein the deactivator mechanism includes a trigger operably connected to a switch that controls the supply of electrical energy to the motor/fan assembly.

15. The wet/dry bare floor cleaner from claim 14, wherein the handle comprises a hand grip, and the trigger is positioned on one side of the hand grip for convenient operation by a finger of a user in the wet mode position and for inconvenient operation by the finger of the user in the dry mode position.

16. The wet/dry bare floor cleaner from claim 12, wherein the handle is at an acute angle with respect to the vertical in a first direction in the dry mode position and the handle in at an acute angle with respect to the vertical in a second direction in the wet mode position.

17. The wet/dry bare floor cleaner from claim 12, wherein the recovery system includes a diverter valve movable between an open position when the handle is in the dry mode position and a closed position when the handle is in the wet mode position.

18. The wet/dry bare floor cleaner from claim 12 and further comprising a suction nozzle on the base.

19. The wet/dry bare floor cleaner from claim 18, wherein the recovery system includes a motor/fan assembly carried by one of the one handle and the base, and a diverter valve movable between an open position when the handle is in the dry mode position and a closed position when the handle is in the wet mode position, wherein the motor/fan assembly is blocked from fluid communication with the suction nozzle when the diverter valve is in the closed position.

20. The wet/dry bare floor cleaner from claim 18, wherein the suction nozzle is positioned on one side of the base and the fluid distributor is positioned on another side of the base.

* * * * *